United States Patent [19]

Marshall et al.

[11] 4,317,651

[45] Mar. 2, 1982

[54] WEAPONS TRAINING APPARATUS FOR SIMULATING LONG RANGE WEAPONS

[75] Inventors: Albert H. Marshall; Gary M. Bond, both of Orlando; Bon F. Shaw, Winter Park, all of Fla.

[73] Assignee: The United States of America as represented by the Secretary of the Navy, Washington, D.C.

[21] Appl. No.: 199,156

[22] Filed: Oct. 21, 1980

[51] Int. Cl.[3] ..... F41G 3/26

[52] U.S. Cl. ..... 434/22

[58] Field of Search ..... 434/22; 273/310, 312, 273/316, 371, 381

[56] References Cited

U.S. PATENT DOCUMENTS

| | | | |
|---|---|---|---|
| 3,657,826 | 4/1972 | Marshall et al. | 434/22 |
| 3,813,795 | 6/1974 | Marshall et al. | 434/22 |
| 3,927,480 | 12/1975 | Robertsson | 434/22 |
| 3,995,376 | 12/1976 | Kimble et al. | 434/22 |
| 4,164,081 | 8/1979 | Berke | 434/22 |
| 4,177,580 | 12/1979 | Marshall et al. | 434/22 |
| 4,195,422 | 4/1980 | Budmiger | 434/22 X |
| 4,281,993 | 8/1981 | Shaw | 434/22 |

*Primary Examiner*—William H. Grieb

*Attorney, Agent, or Firm*—Robert F. Beers; Robert W. Adams; David S. Kalmbaugh

[57] ABSTRACT

A weapons training apparatus is disclosed for simulating long range weapons so as to train a marksman in the use of the particular weapon being simulated. The weapons training apparatus comprises a laser transmitter mounted within the weapon being simulated which, when activated by the marksman, broadcast at a target a square wave beam of laser light having a predetermined frequency. A receiver, mounted upon the target, will sense only a square wave laser light beam having the predetermined frequency mentioned above, and activate a buzzer so as to indicate that the marksman has scored a hit upon the target.

17 Claims, 5 Drawing Figures

WEAPONS TRAINING APPARATUS FOR SIMULATING LONG RANGE WEAPONS

BACKGROUND OF THE INVENTION

1. Field of the Invention

This invention relates generally to weapons training simulators. In particular, this invention relates to a weapons training simulator which utilizes a laser transmitter at the firing point, and a receiver at the aiming point so as to provide an efficient hit indication of the target aimed at by a trainee marksman.

2. Description of the Prior Art

In training military and other personnel in the use of long range weapons, rifles, and the like, the military, as well as civilian agencies concerned with such training, have utilized laser emissions instead of live ammunition at the firing point, and a form of detector apparatus at the target, or aiming point, combined with some audible or visible indication that a hit has been scored upon the target.

One such device of the prior art utilizes an array of solar cells combined with transformers, detectors, and other electronic amplifying equipment affixed directly to the target such that when the target is impinged by a laser beam from the firing point, at least one of the detectors will detect its presence and generator an alarm through the solar cell pick-up and electronic amplifying equipment to activate a hit indicator.

Still another device of the prior art utilizes a target having mounted on the front portion thereof a reflective surface which reflects therefrom an incoming laser beam all the way back to the firing point where a detector is located. The detector, in turn, picks up the retroreflected laser beam and then provides an audible and/or visible indication that a hit has been scored upon the target.

While satisfactory for their intended purpose of marksmanship training, the aforementioned devices of the prior art ordinarily leave something to be desired, especially from the standpoints of aiming accuracy at long distances, safety, and complexity in design. In addition, the aforementioned devices of the prior art are designed for use at limited distances.

SUMMARY OF THE INVENTION

The subject invention overcomes some of the disadvantages of the prior art, including those mentioned above, in that it comprises a relatively simple long range weapons fire simulation system which is responsive to laser light pulses from a laser transmitter rather than being responsive to ordinary light or other less coherent, concentrated, and intense types of radiant energy. Consequently, it is far more sensitive which, in turn, makes it far more efficient and accurate in its response, in that it more closely simulates the aiming accuracy of a long range weapons system.

Included in the subject invention is a receiver, which is mounted upon a target, adapted for detecting a square wave beam of laser light broadcast by a laser transmitter mounted in the weapon being simulated. The receiver, in turn, comprises a sensor element adapted to detect the aforementioned square wave beam of laser light, and for providing, in response to the detection of the square wave beam of laser light, a square wave signal having a frequency the same as the frequency of the square wave beam of laser light.

The aforementioned square wave signal is then amplified by amplifying means and supplied to an active filter which produces, in response to the square wave signal, a sinusoidal waveform signal. The sinusoidal waveform signal is supplied to a level shifting circuit which level shifts the voltage level thereof, and then to a comparator. The comparator will produce a pulse whenever the voltage level of the aforementioned sinusoidal waveform signal exceeds a predetermined value. The pulse produced by the comparator will, in turn, activate a buzzer so as to indicate that a hit has been scored upon the target.

DESCRIPTION OF THE PREFERRED EMBODIMENT

Figure 1:
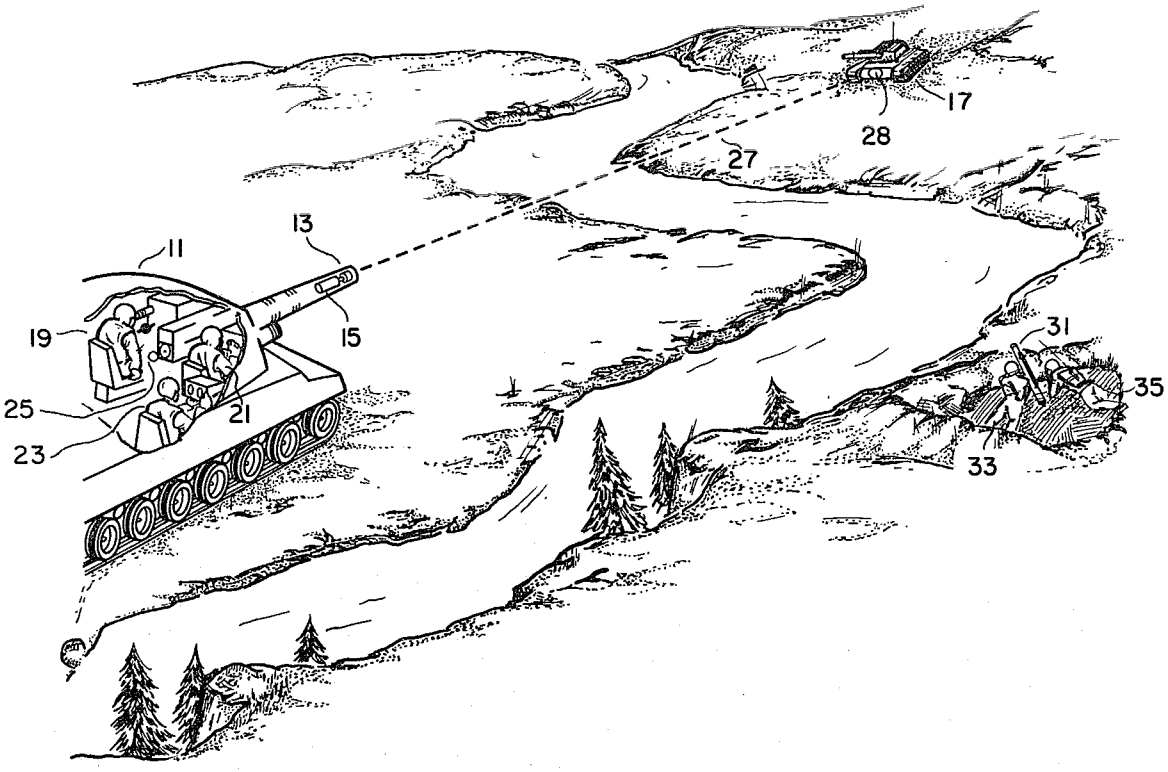
FIG. 1 is a pictorial representation of a typical situation in which the subject invention may be utilized to an advantage.

The preferred embodiment of the subject invention will now be discussed in some detail in conjunction with all of the figures of the drawing wherein like parts are designated by like reference numerals, insofar as it is possible and practical to do so.

Referring now to FIG. 11, there is shown a tank 11 having a barrel 13 in which is mounted a laser transmitter 15. As tank 11 is aimed for direct fire maneuvers at a tank 17, barrel 13 of tank 11 is moved in azimuth and elevation by trainees 19, 21, and 23. Tank 11 is fired in simulation by trainee 19, activating a three position selector switch 25, which is the trigger mechanism of the subject invention and, when activated by trainee 19, energizes laser transmitter 15 such that laser transmitter 15 will broadcast along a predetermined optical or light path a square wave beam of laser light 27.

Mounted upon tank 17 is a receiver 28 which will detect the square wave beam of laser light 27 broadcast by laser transmitter 15. Whenever receiver 28 detects the square wave beam of laser light 27 broadcast by laser transmitter 15, receiver 28 will activate a buzzer 29, FIG. 2, located in tank 17. This, in turn, indicates to an instructor, not shown, seated in tank 17 that trainees 19, 21, and 23 have scored a hit upon tank 17.

At this time, it may be noted that a variety of weapons such as a bazooka 31, may be utilized with the subject invention by mounting laser transmitter 15 therein. This, in turn, allows trainees 33 and 35 to aim and fire bazooka 31, in simulation, at tank 17.

Figure 2:
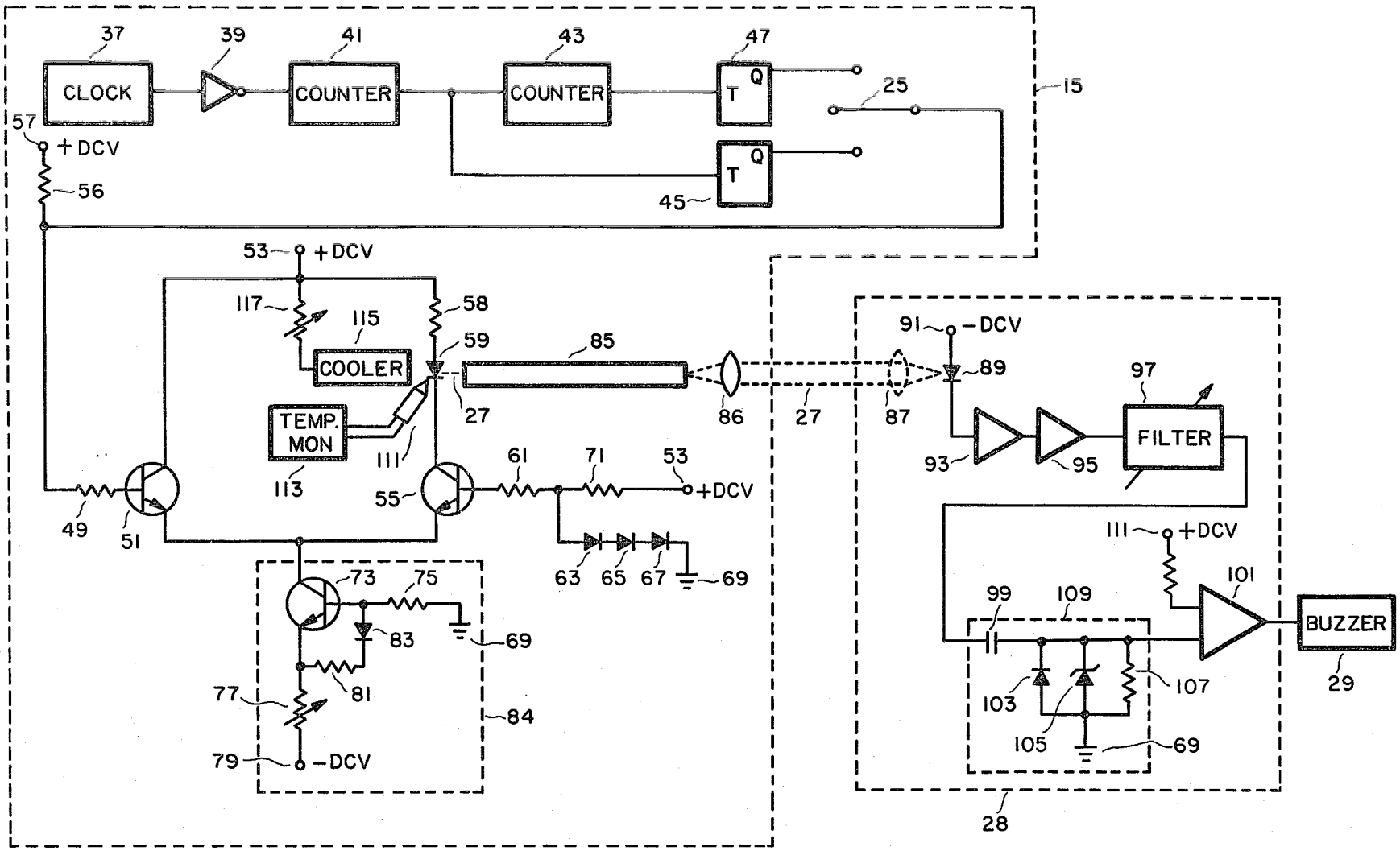
FIG. 2 is an electrical schematic of the system constituting the subject invention.

Referring now to FIG. 2, there is shown a schematic diagram of laser transmitter 15 comprising a master clock 37, the output of which is connected to the input of an inverter 39 with the output thereof connected to the input of a counter 41. The output of counter 41 is, in turn, connected to the input of a counter 43, and the trigger input of a flip-flop 45.

The output of counter 43 is connected to the trigger input of a flip-flop 47, the Q output of which is connected to the first input of three position selector switch 25. In addition, the Q output of flip-flop 45 is connected to the second input of selector switch 25, with the third or neutral input thereof being left unconnected.

The output of selector switch 25 is connected through a resistor 49 to the base of a NPN transistor 51, the collector of which is connected to the output of a positive direct current voltage source 53, and the emitter of which is connected to the emitter of a NPN transistor 55. In addition, the base of NPN transistor 51 is connected through resistor 49 and a resistor 56 to the output of a positive direct current voltage source 57.

The output of positive direct current voltage source 53 is connected through a resistor 58 to the input of a laser light source 59 which emits therefrom, when activated, the aforementioned square wave beam of laser light 27. The output of laser light source 59 is, in turn, connected to the collector of NPN transistor 55, the base of which is connected through a resistor 61 to the input of a diode 63. The output of diode 63 is connected to the input of a diode 65, the output of which is connected to the input of a diode 67, with the output thereof connected to a ground 69. In addition, the base of NPN transistor 55 is connected through resistor 61 and a resistor 71 to the output of positive direct current voltage source 53.

The emitters of NPN transistors 51 and 55 are connected to the collector of a NPN transistor 73, the base of which is connected through a resistor 75 to ground 69. The emitter of NPN transistor 73 is connected through a variable resistor 77 to the output of a negative direct current voltage source 79. In addition, the emitter of NPN transistor 73 is connected through a resistor 81 to the output of a diode 83, the input of which is connected to the base of NPN transistor 73.

It should be noted that the combination of NPN transistor 73, resistors 75, and 81, diode 83, variable resistor 77 and negative direct current voltage source 79 when connected in the manner described above form a constant current source 84, the operation of which will be discussed more fully below.

Spatially disposed downstream from laser light source 59 along optical light path 27 is a fiber optics bundle 85 which, along with laser light source 59, is commercially available from RCA of Lancaster, Penn., with the model number being C86010E.

Spatially disposed downstream from fiber optics bundle 85 along optical light path 27 is a lens 86. Lens 86 is positioned such that the focal point thereof is located at the end of fiber optics bundle 85.

Spatially disposed downstream from lens 86 along optical light path 27 is receiver 28 which includes a lens 87 positioned downstream from lens 86. Spatially disposed downstream from lens 87 is a photodiode sensor 89 which is positioned at the focal point of lens 87.

The output of a negative direct current voltage source 91 is connected to the input of photodiode sensor 89, the output of which is connected to the input of an amplifier 93, with the output thereof connected to the input of an amplifier 95. The output of amplifier 95 is, in turn, connected to the input of an active filter 97, with the output thereof connected through a coupling capacitor 99 to the first input of a comparator 101. Connected between ground 69 and the first input of comparator 101, in parallel, are a diode 103, a zener diode 105, and a resistor 107. Connected to the second input of comparator 101 through a resistor is the output of a positive direct current voltage source 111. The output of comparator 101, in turn, is connected to the input of buzzer 29.

It should be noted that the combination of coupling capacitor 99, diode 103, zener diode 105, and resistor 107, when connected in the manner described above, form a level shifting circuit 109, the operation of which will be described more fully below.

In addition, it may be noteworthy to mention that the series combination of photodiode sensor 89 and amplifier 93 may be, for example, a hybrid receiver Model MDA 7705 manufactured by Meret, Inc. of Santa Monica, Calif. Further, it may be noted that active filter 97 may be a universal active filter Model UAF 41 manufactured by Burr-Brown, Inc., of Tucson, Ariz.

Affixed to laser light source 59 is a temperature probe 111, the first terminal of which is connected to the first terminal of a temperature monitor 113 and the second terminal of which is connected to the second terminal of temperature monitor 113. Position adjacent laser light source 59 is a cooler element 115, the output of which is connected through a variable resistor 117 to the output of direct current voltage source 53.

It may be noted at this time that cooler element 103 may be a thermo-electric module, Model 930-71, manufactured by Borg-Warner, Inc. of Des Plaines, Ill. In addition, temperature monitor 113 may be an Omega-temp Temperature Monitor manufactured by Omega Engineering, Inc. of Stamford, Conn.

The operation of the subject invention will now be discussed briefly in conjunction with all of the figures of the drawing.

Referring first to FIG. 1, there is shown tank 11, the barrel 13 of which is being aimed in azimuth and elevation by trainees 19, 21, and 23 for direct fire maneuvers at tank 17. Tank 11 is then fired in simulation by trainee 19 activating three position selector switch 25 which, when activated by trainee 19, energizes laser transmitter 15 such that laser transmitter 15 will broadcast square wave laser light beam 27 at tank 17. Whenever receiver 28 detects the square wave beam of laser light 27 broadcast by laser transmitter 15, receiver 28 will activate buzzer 29, FIG. 2. This, in turn, indicates to the aforementioned instructor, not shown, seated in tank 17 that trainees 19, 21, and 23 have scored a hit upon tank 17.

Figure 3:
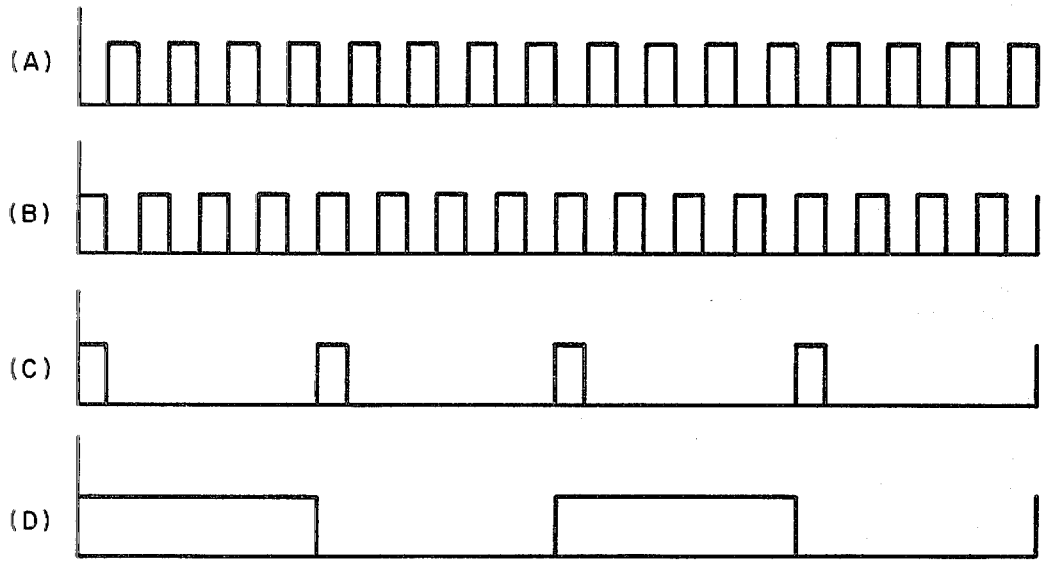
FIG. 3 is an ideal graphical representation of some of the signals produced at the outputs of some of the elements of the laser transmitter of FIG. 2.

As mentioned above, a variety of weapons, such as bazooka 31, may be utilized with the subject invention by mounting laser transmitter 15 therein. Because the subject invention operates in the same manner when laser transmitter 15 is mounted in barrel 13 of tank 11 as when laser transmitter 15 is mounted in bazooka 31, and for the sake of keeping this disclosure as simple as possible, only the operation of the subject invention with respect to tank 11 will be described Referring now to FIG. 2, there is shown clock 37 which generates a master clock signal having a preset frequency of 786 kilohertz similar to that depicted in FIG. 3(A). The clock signal of FIG. 3(A) is supplied to the input of inverter 39 which inverts the aforementioned clock signal so as to provide at the output thereof a clock signal similar to that illustrated in FIG. 3(B). The clock signal of FIG. 3(B) is then supplied to the input of counter 41 which divides the frequency thereof by four so as to provide at the output thereof a clock signal similar to that depicted in FIG. 3(C).

The clock signal of FIG. 3(C) is supplied to the trigger input of flip-flop 45, which divides the frequency thereof by two so as to provide at the Q output thereof a clock signal similar to that illustrated in FIG. 3(D), the frequency of which is 98.25 kilohertz.

Figure 4:
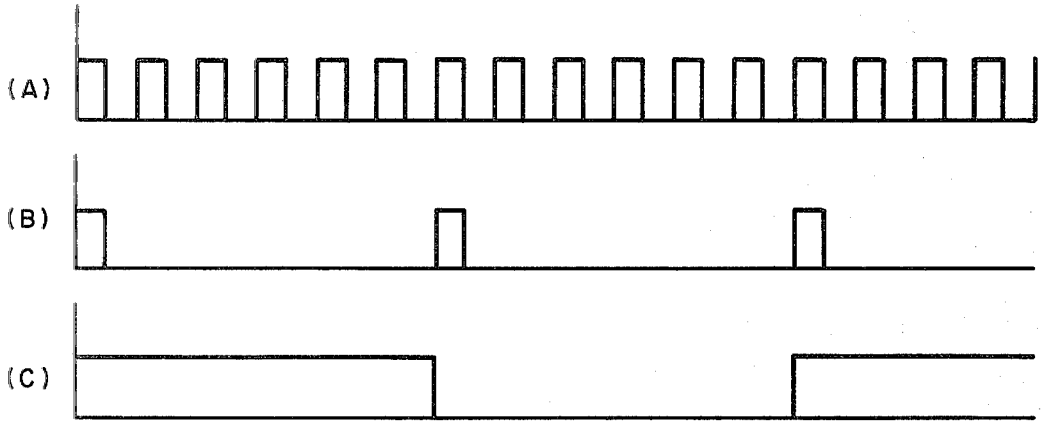
FIG. 4 is an expanded graphical representation of one of the signals of FIG. 3 and other internal component output signals of the laser transmitter of FIG. 2 coordinated therewith.

To facilitate the better understanding of that portion of the mode of operation of the invention to be discussed now, it would appear to be noteworthy to mention at this time that the signal waveform of FIG. 4(A) is, in fact, identical to that of FIG. 3(C). However, in the portrayal of the signal waveform of FIG. 4(A), the time frame represented by the abscissa has been greatly reduced so as to provide a frame that will permit the disclosure of the other signals shown in FIG. 4(B) and FIG. 4(C).

The signal of FIG. 4(A) which emanates from the output of counter 41 is supplied to the input of counter 43 which divides the frequency thereof by six so as to provide at the Q output thereof a clock signal similar to that illustrated in FIG. 4(B). The clock signal of FIG. 4(B) is then supplied to the trigger input of flip-flop 47 which divides the frequency thereof by two so as to provide at the Q output thereof a clock signal similar to that illustrated in FIG. 4(C), the frequency of which is 16.375 kilohertz.

At this time, it should be noted that the clock signal of either FIG. 3(D) or FIG. 4(C) may be utilized by the subject invention since receiver 28, as will be discussed more fully below, may be adjusted to detect a square wave beam of laser light having a frequency between ten hertz and two hundred kilohertz. However, for the sake of keeping this disclosure as simple as possible, and because laser transmitter 15 operates in the same manner, whether the clock signal of FIG. 3(D) or the clock signal of FIG. 4(C) is utilized thereby, the operation of laser transmitter 15 will be described with respect to the clock signal of FIG. 4(D).

In addition, it may be noteworthy to mention that the clock signal of FIG. 4(D) is adapted for utilization with a receiver element described in U.S. patent application Ser. No. 199,406 entitled Marksmanship Training Device for Simulating Long Range Weapons by Albert H. Marshall, Gary M. Bond and Bon F. Shaw, filed concurrently with this application.

The clock signal of FIG. 4(C) which emanates from the Q output of flip-flop 47 passes through selector switch 25 and resistor 49 to the base of transistor 51 so as to activate transistor 51. Whenever the base of transistor 51 is in the logic "1" state, or in response to each clock pulse of the clock signal of FIG. 4(C), the positive direct current voltage signal provided by direct current voltage source 53 will pass through transistors 51 and 73, and variable resistor 77 to the output of negative direct current voltage source 79. This, in turn, inactivates transistor 55, which is reverse biased at the base to emitter junction thereof, thereby inactivating laser light source 59 so as to prevent the aforementioned laser light source 59 from broadcasting square wave laser light beam 27, as will be discussed more fully below.

Whenever the clock signal of FIG. 4(C) is in the logic "0" state, transistor 51 is inactivated, thereby activating transistor 55 which is now forward biased at the base to emitter junction thereof due to the voltage drop across resistor 71. This, in turn, allows the direct current voltage signal provided by direct current voltage source 53 to pass through resistor 58, light source 59, and transistor 55 so as to activate light source 59. Laser light source 59, in response to the direct current voltage signal provided by direct current voltage source 53, provides a stream of laser light. Thus, in response to the clock signal of FIG. 4(C), laser light source 59 will broadcast along the above mentioned predetermined optical light path square wave beam of laser light 27.

At this time, it should be noted that the series combination of resistor 71 and diodes 63, 65, and 67 form a voltage divided circuit such that the base of transistor 55 is biased at a constant voltage. This, in turn, assures that the base to emitter junction of transistor 55 is forward biased whenever transistor 51 is inactivated by the clock signal of FIG. 4(C).

Whenever selector switch 25 is in the neutral position, so as to prevent the clock signal of either FIG. 3(D) or FIG. 4(C) from passing therethrough, the direct current voltage signal provided by direct current voltage source 57 will pass through resistors 56 and 49 to the base of transistor 51 such that the base of transistor 51 will be in the logic "1" state. This, in turn, as discussed previously, activates transistor 51 such that the direct current voltage signal provided by direct current voltage source 53 will pass therethrough so as to inactivate laser light source 59, thereby preventing laser light source 59 from broadcasting square wave beam of laser light 27.

At this time, it may be noteworthy to mention that the direct current voltage signal provided by direct current voltage source 53 is maintained at a constant current level of approximately two hundred milliamps, so as to maintain the power output of square wave laser light beam 27 at a constant power level of two milliwatts. A negative direct current voltage signal provided by direct current voltage source 79 flows from ground 69, through resistor 75, diode 83, resistor 81, and variable resistor 77, to direct current voltage source 79, such that the voltage drop from the base of transistor 73 to the emitter thereof remains at a constant value. This, in turn, will cause the direct current voltage signal provided by direct current voltage source 53 to remain at the aforementioned current level of approximately two hundred milliamps.

In addition, it should be noted that an increase in the resistance of variable resistor 77 will decrease the current level of the direct current voltage signal provided by direct current voltage source 53, while a decrease in the resistance of variable resistor 77 will increase the current level of the aforementioned direct current voltage signal. This, in turn, allows for the variation of the output power level of square wave laser light beam 27 broadcast by laser light source 59.

Also, it may be noteworthy to mention that diode 83 is utilized within the subject invention to compensate for temperature variations within transistor 73 such that when transistor 73 is active, the direct current passing therethrough will remain constant.

Further, it should be noted that temperature probe 99 continuously monitors the temperature of laser light source 59. Temperature probe 99 then supplies to temperature monitor 101 an analog signal proportional to the temperature of laser light source 59 monitored thereby. Temperature monitor 101, in response to the aforementioned analog signal, will provide trainees 19, 21, and 23, FIG. 1, with a visual indication of the temperature of laser light source 59 so as to allow one of the aforementioned trainees to adjust variable resistor 105, thereby either increasing or decreasing the cooling capacity of cooler element 103. This, in turn, insures that the temperature of laser light source 59 will remain at a constant value so as to make certain that the output power level of square wave laser light beam 27 broadcast by laser light source 59 will remain at the aforementioned value of two milliwatts.

Referring now to FIGS. 1 and 2, whenever tank 11 is fired in simulation by trainee 19 activating three position selector switch 25, laser light source 59 broadcasts through fiber optics bundle 85 square wave laser light beam 27. Fiber optics bundle 85, in turn, integrates square wave laser light beam 27 such that the square wave laser light beam 27 which appears at lens 86 is circular in shape, thus simulating a live round. Lens 86 collimates square wave laser light beam 27 which is then transmitted along the above mentioned optical light path to lens 87 of receiver 28.

Lens 87 focuses square wave laser light beam 27 upon photodiode sensor 89 which, when activated by the negative direct current voltage signal provided by negative direct current voltage source 91, will detect square wave laser light beam 27 broadcast by laser light source 59. Photodiode sensor 89 will then provide at the output thereof, in response to the square wave laser light beam 27 sensed thereby, a square wave signal similar to that illustrated in FIG. 5(A) and having a frequency of 16.375 kilohertz. The square wave signal of FIG. 5(A) is then supplied through amplifiers 93 and 95, which amplify the aforementioned signal to a more useful voltage level, to the input of active filter 97.

Figure 5:
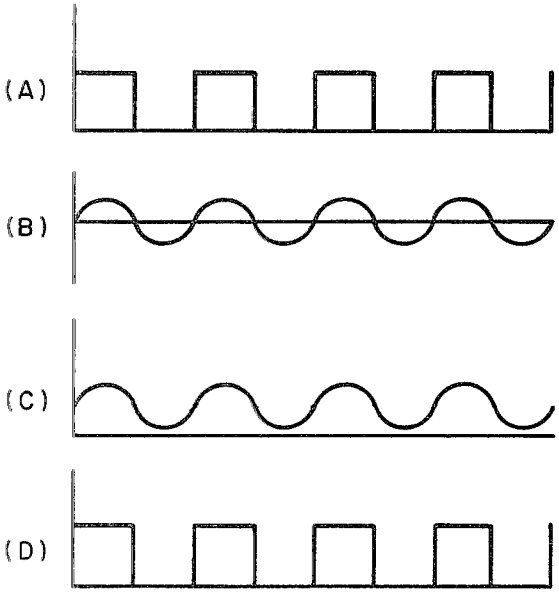
FIG. 5 is an ideal graphical representation of some of the signals produced at the outputs of some of the elements of the receiver of FIG. 2.

Active filter 97 is preset to produce at the output thereof a simusoidal waveform signal similar to that illustrated in FIG. 5(B) upon receiving at the input thereof a square wave signal having a frequency of 16.375 kilohertz. Thus, whenever the square wave signal of FIG. 5(A) is supplied to the input of active filter 97, active filter 97 will produce at the output thereof the simusoidal waveform signal of FIG. 5(B).

The sinusoidal waveform signal of FIG. 5(B) is then supplied to level shifter 109 which shifts the voltage level thereof so as to form a sinusoidal waveform signal similar to that depicted in FIG. 5(C). Coupling capacitor 99 removes from the sinusoidal waveform signal of FIG. 5(B) the direct current voltage component therein. In addition, zener diode 105 insures that the voltage level of the sinusoidal waveform signal of FIG. 5(C) does not exceed a predetermined maximum value of approximately fifteen volts while diode 103 insures that the voltage level of the sinusoidal waveform signal of FIG. 5(C) does not become less than a predetermined minimum value of zero volts.

The sinusoidal waveform signal of FIG. 5(C) is supplied to the first input of comparator 101 which compares the aforementioned signal with a positive direct current voltage signal provided by direct current voltage source 101 such that whenever the voltage level of the signal of FIG. 5(C) exceeds the voltage level of the aforementioned positive direct current voltage signal, a logic "1" state will appear at the output of comparator 101. This, in turn, results in comparator 101 providing at the output thereof, in response to the sinusoidal waveform signal of FIG. 5(C), a signal similar to that depicted in FIG. 5(D). The signal of FIG. 5(D) is then supplied to the input of buzzer 29, thereby activating buzzer 29 so as to indicate to the instructor seated in tank 17 that tank 11 has scored a hit upon tank 17.

It should be noted that comparator 101 acts as a thresholder so as to prevent spurious noise within the sinusoidal waveform signal of FIG. 5(C) from falsely triggering buzzer 29. This, in turn, assures that buzzer 29 will be activated only when a hit has been scored on tank 17.

In addition, it should be mentioned that active filter 97 may be adjusted to receive a square wave signal having a frequency between ten hertz and two hundred kilohertz, and produce a sinusoidal waveform signal having a frequency the same as the frequency of the signal received thereby. Thus, active filter 97 may be adjusted to produce at the output thereof a sinusoidal waveform signal upon receiving at the input thereof a square wave signal having a frequency of 98.25 kilohertz. This, in turn, allows selector switch 25 to be positioned such that the clock signal of FIG. 3(D) will pass therethrough, thereby activating laser light source 59 which will broadcast along optical light path 27 a square wave beam of laser light having a frequency of 98.25 kilohertz. Photodiode sensor 89 will then provide at the output thereof, in response to the aforementioned square wave beam of laser light, a square wave signal having a frequency of 98.25 kilohertz. This, in turn, activates filter 97 so as to energize buzzer 29, thereby indicating to the instructor seated within tank 17 that a hit has been scored thereon.

From the foregoing, it may readily be seen that the subject invention comprises a new, unique, and exceedingly useful weapons training apparatus for simulating long range weapons which constitutes a considerable improvement over the known prior art. Obviously, many modifications and variations of the present invention are possible in light of the above teachings. It is, therefore, to be understood that within the scope of the appended claims the invention may be practiced otherwise than as specifically described.

What is claimed is:

1. A marksmanship training apparatus comprising, in combination:

an imitation weapon having a barrel, and a trigger mechanism, said trigger mechanism having an input and an output;

transmitting means mounted within the barrel of said imitation weapon, and having an input connected to the output of said trigger mechanism, and an output adapted for broadcasting along a predetermined optical path a collimated square wave beam of laser light, said square wave beam of laser light having a predetermined frequency;

sensing means spatially disposed downstream from said transmitting means, and having an input adapted for detecting the collimated pulsed beam of laser light broadcast along said predetermined optical path, and for producing at the output thereof a square wave signal whenever the square wave beam of laser light broadcast along said predetermined optical path is detected thereby, said square wave signal having a frequency the same as the frequency of said square wave beam of laser light;

filtering means having an input connected to the output of said sensing means, and an output for providing at the output thereof a sinuosidal waveform signal in response to the square wave signal produced by said sensing means, said sinusoidal waveform signal having a frequency that is identical to that of said square wave signal;

means having an input connected to the output of said filtering means, and an output for shifting the voltage level of said sinusoidal waveform signal; and comparing means having an input connected to the output of said voltage level shifting means, and an output for producing at the output thereof a series of pulses with each pulse being provided thereby only when said sinusoidal waveform signal exceeds a predetermined voltage level.

2. The marksmanship training apparatus of claim 1, wherein said weapon comprises a tank.

3. The marksmanship training apparatus of claim 1, wherein said weapon comprises a bazooka.

4. The marksmanship training apparatus of claim 1, wherein said trigger mechanism comprises a three position selector switch.

5. The marksmanship training device of claim 1, wherein said transmitting means comprises:

a master clock having an output;

a first counter having an input connected to the output of said master clock, and an output;

a second counter having an input connected to the output of said first counter, and an output;

a flip-flop having a trigger input connected to the output of said second counter, and a Q output connected to the input of said trigger mechanism;

a first positive direct current voltage source having an output;

a laser light source having an input connected to the output of said first positive direct current voltage source;

a first transistor having a base, an emitter, and a collector, with the base thereof connected to the output of said trigger mechanism, and with the collector thereof connected to the output of said first positive direct current voltage source;

a first resistance having first and second terminals with the first terminal thereof connected to the output of said first positive direct current voltage source;

a ground;

a second resistance having first and second terminals with the first terminal thereof connected to the second terminal of said first resistance, and with the second terminal thereof connected to said ground;

a second transistor having a base, an emitter, and a collector with the base thereof effectively connected to the second terminal of said first resistance and the first terminal of said second resistance, and with the collector thereof connected to the output of said laser light source;

a second positive direct current voltage source having an output connected to the base of said first transistor;

a negative direct current voltage source having an output;

a constant current circuit having first, second, and third terminals, with the first terminal thereof effectively connected to the emitters of said first and second transistors, with the second terminal thereof connected to said ground, and with the third terminal thereof connected to the output of said negative direct current voltage source;

a lens spatially disposed downstream from said laser light source along said predetermined optical path; and a fiber optics bundle positioned between said lens and said laser light source along said predetermined optical path.

6. The marksman training apparatus of claim 1, wherein said sensing means comprises:

a lens spatially disposed downstream from said transmitting means;

a photodiode receiver spatially disposed downstream from said lens, and having an input and an output;

a negative direct current voltage source having an output connected to the input of said photodiode receiver; and an amplifier having an input connected to the output of said lens.

7. The marksmanship training apparatus of claim 1, wherein said voltage level shifting means comprises:

a coupling capacitor having first and second terminals, with the first terminal thereof connected to the output of said filtering means, and with the second terminal thereof connected to the input of said comparing means;

a ground;

a diode having an input connected to said ground, and an output connected to the input of said comparing means;

a zener diode having an input connected to said ground, and an output connected to the input of said comparing means; and a resistor connected between said ground and the input of said comparing means.

8. The marksmanship training apparatus of claim 1, wherein said comparing means comprises:

a comparator having first and second inputs with the first input thereof connected to the output of said voltage level shifting means; and a positive direct current voltage source having an output connected to the second input of said comparator.

9. The marksmanship training apparatus of claim 1, further characterized by an amplifier connected between the output of said sensing means and the input of said filtering means.

10. The marksmanship training apparatus of claim 1, further characterized by a buzzer having an input connected to the output of said comparing means.

11. A weapons training simulator comprising, in combination:

a laser transmitter for projecting along a predetermined light path a collimated square wave beam of laser light, said collimated square wave beam of laser light having a predetermined frequency;

a photodiode sensor spatially disposed downstream from said laser transmitter, and having an input and an output for detecting the collimated square wave beam of laser light broadcast along said predetermined light path, and for producing a square wave signal whenever the square wave beam of laser light broadcast along said predetermined light path is detected thereby, said square wave signal having a frequency the same as the frequency of said square wave beam of laser light;

a lens positioned between said laser transmitter and said photodiode sensor adapted for focusing the square wave beam of laser light broadcast along said predetermined light path upon said photodiode sensor;

a negative direct current voltage source having an output connected to the input of said photodiode sensor for providing a negative direct current voltage signal so as to effect the activation of said photodiode sensor;

an amplifier having an input connected to the output of said photodiode sensor and an output for amplifying the square wave signal produced by said photodiode sensor;

an active filter having an input connected to the output of said amplifier, and an output for producing at the output thereof a sinusoidal waveform signal in response to the square wave signal amplified by said amplifier, said sinusoidal waveform signal having a frequency the same as that of said square wave signal;

a level shifter having an input connected to the output of said active filter and an output for shifting the voltage level of said sinusoidal waveform signal; and a comparator having a first input connected to the output of said level shifter, a second input, and an output for producing at the output thereof a series of pulses with each pulse being produced thereby only when said sinusoidal waveform signal exceeds a predetermined voltage level;

12. The weapons training simulator of claim 11, wherein said laser transmitter comprises:

a master clock having an output;

a first counter having an input connected to the output of said master clock, and an output;

a second counter having an input connected to the output of said first counter, and an output;

a first flip-flop having a trigger input connected to the output of said second counter, and a Q output;

a second flip-flop having a trigger input connected to the output of said first counter, and a Q output;

a three position selector switch having a first input connected to the Q output of said first flip-flop, a second input connected to the Q output of said second flip-flop, and an output;

a first transistor having a base, an emitter, and a collector, with the base thereof connected to the output of said selector switch;

a first positive direct current voltage source having an output connected to the collector of said first transistor;

a laser light source having an input connected to the output of said first positive direct current voltage source, and an output;

a first resistance having first and second terminals with the first terminal thereof connected to the output of said first positive direct current voltage source;

a ground;

a second resistance having first and second terminals with the first terminal thereof connected to the second terminal of said first resistance, and with the second terminal thereof connected to said ground;

a second transistor having a base, an emitter, and a collector with the base thereof effectively connected to the second terminal of said first resistance and the first terminal of said second resistance, and with the collector thereof connected to the output of said laser light source;

a second positive direct current voltage source having an output connected to the base of said first transistor;

a negative direct current voltage source having an output; and a constant current circuit having first, second, and third terminals, with the first terminal thereof effectively connected to the emitters of said first and seconsd transistors, with the second terminal thereof connected to said ground, and with the third terminal thereof connected to the output of said negative direct current voltage source;

a lens spatially disposed downstream from said laser light source along said predetermined light path; and a fiber optics bundle positioned between said laser light source and said lens along said predetermined light path.

13. The weapons training simulator of claim 12, wherein said constant current source comprises:

an NPN transistor having a base, an emitter, and a collector, with the collector thereof effectively connected to the emitters of said first and second transistors;

a first fixed resistance having a first terminal connected to said ground, and a second terminal connected to the base of said NPN transistor;

a diode having an input connected to the base of said NPN transistor, and an output;

a second fixed resistance connected between the output of said diode and the emitter of said NPN transistor; and a variable resistance having a first terminal connected to the emitter of said NPN transistor, and a second terminal connected to the output of said negative direct current voltage source.

14. The weapons training simulator of claim 11, wherein said photodiode sensor comprises:

a photodiode receiver having an input connected to the output of said negative direct current voltage source; and an amplifier having an input connected to the output of said photodiode receiver.

15. The weapons training simulator of claim 11, wherein said level shifter comprises:

a coupling capacitor having first and second terminals, with the first terminal thereof connected to the output of said active filter, and with the second terminal thereof connected to the first input of said comparator;

a ground;

a diode having an input connected to said ground, and an output connected to the first input of said comparator;

a zener diode having an input connected to said ground, and an output connected to the first input of said comparator; and a resistor connected between said ground and the first input of said comparator.

16. The weapons training simulator of claim 11, further characterized by a positive direct current voltage source having an output connected to the second input of said comparator.

17. The weapons training simulator of claim 11, further characterized by a buzzer having an input connected to the output of said comparator.

* * * * *